United States Patent [19]

Shatz

[11] 4,266,308

[45] May 12, 1981

[54] BED COVERING

[76] Inventor: Mark F. Shatz, 1204 Short St., Union City, Tenn. 38261

[21] Appl. No.: 91,090

[22] Filed: Nov. 5, 1979

[51] Int. Cl.[3] ..... A47G 9/00; A47C 23/00

[52] U.S. Cl. ..... 5/494; 5/497; 5/499

[58] Field of Search ..... 5/494–499, 5/500, 502

[56] References Cited

U.S. PATENT DOCUMENTS

| | | | |
|---|---|---|---|
| 2,191,963 | 2/1940 | London | 5/499 |
| 2,525,713 | 10/1950 | North | 5/494 |
| 2,543,552 | 2/1951 | Leader et al. | 5/499 |
| 2,644,962 | 7/1953 | McCrory | 5/494 |
| 2,695,414 | 11/1954 | Ford | 5/494 |
| 3,521,309 | 7/1970 | Evans | 5/494 |
| 3,681,795 | 8/1972 | Palenske et al. | 5/497 |
| 4,161,044 | 7/1979 | Bogle | 5/494 |

*Primary Examiner*—Casmir A. Nunberg

[57] ABSTRACT

An improved bed covering including a first sheet defining a pocket to receive the bottom end of a mattress and a second sheet attached to the first sheet at the corners and bottom edge of the mattress end.

10 Claims, 3 Drawing Figures

BED COVERING

BACKGROUND OF THE INVENTION

1. Field of the Invention

The present invention relates to the field of bed coverings, and more particularly to a bed covering which combines a bottom sheet for a mattress and a top sheet.

2. Description of the Prior Art

Various forms of bed coverings have been proposed in the prior art. Such bed coverings are directed either at the standard forms of sheets and blankets used to cover beds or at a more complicated combination of the two for particular purposes. The present invention provides a bed covering which is intended for the typical use but which provides particular advantages in such use.

In U.S. Pat. No. 3,521,309, issued to Evans on July 21, 1970, there is disclosed a crib sheet in which a pocket member is secured to a base sheet. In the Evans construction, the bottom sheet corresponds generally to the typical contour of fitted sheet and a second sheet is stitched to the contour sheet in a generally U-shaped manner to form a pocket on the top of a mattress. This design provides a pocket within which a baby may be secured to prevent undesired movement of the baby during sleep. In the McCrory patent, U.S. Pat. No. 2,644,962, issued on July 14, 1953, there is disclosed a bed covering which provides for the attachment of a separate top sheet to a contour bottom sheet. The contour sheet includes several strap members which are securable to corresponding strap members in a separate, upper sheet.

In U.S. Pat. No. 2,525,713, issued to North on Oct. 10, 1950, there is disclosed a twin sheet sleeping garment comparable to a sleeping bag for a bed. The North garment includes a bottom sheet and a top sheet which is secured to the bottom sheet along side margin seams. An elastic securement is provided at the bottom or foot of the mattress. There is no bottom seam at the foot of the bed, but instead the elastic band is secured to the bottom of the top sheet and extends between the two side seams to provide attachment. An article of bedding which provides additional space for the feet of a person lying in the bed is disclosed in U.S. Pat. No. 2,695,414, issued to Ford et al. on Nov. 30, 1954.

In contrast to the bed coverings of the prior art, the present invention provides a bed covering which combines, typically, a standard contour sheet and flat sheet in a manner to facilitate handling and storage of bed sheets and to simplify the procedure of making a bed with such sheets.

SUMMARY OF THE INVENTION

In one aspect, the present invention provides an improved bed covering which comprises a bottom sheet defining a pocket for reception of the end of a mattress and a top sheet secured to the pocket at locations corresponding to the bottom corners of the mattress and the bottom edge of the end of the mattress.

It is an object of the present invention to provide an improved bed covering which makes it easier and quicker to prepare a bed.

Another object of the present invention is to provide an improved bed covering which simplifies the storage and inventorying of sheets.

It is a further object of the present invention to provide an improved bed covering which provides for the saving of sheet material.

Another object of the present invention is to provide an improved bed covering which simplifies the making of a bed while providing free and normal access to the bed.

Further objects and advantages of the present invention will become apparent from the description of the preferred embodiment which follows.

DESCRIPTION OF THE PREFERRED EMBODIMENT

Figure 1:
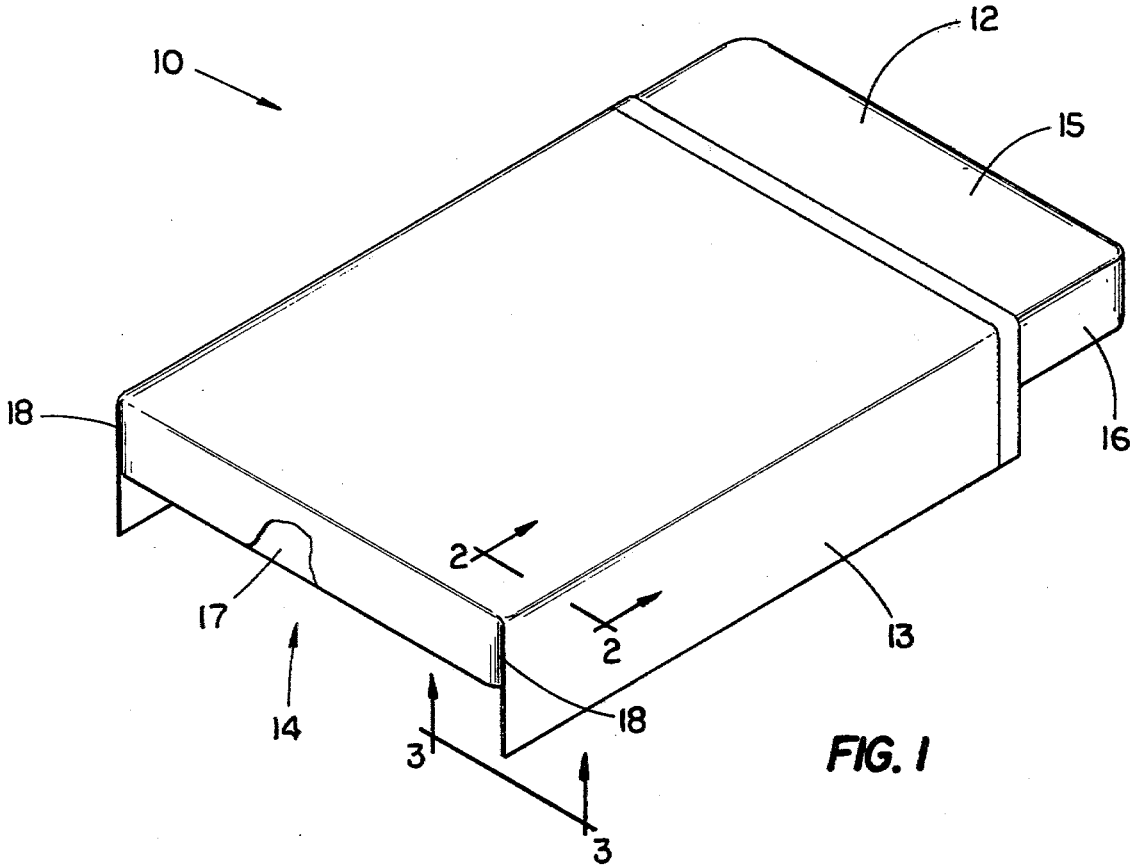
FIG. 1 is a perspective view of a mattress having the improved bed covering of the present invention installed thereon.
Figure 2:
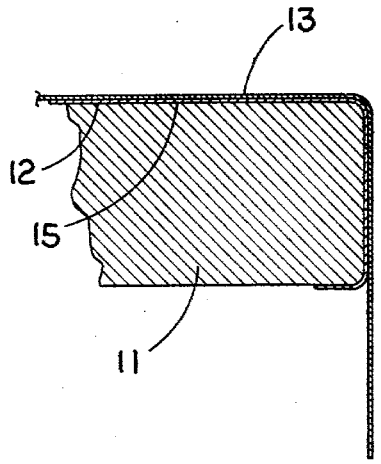
FIG. 2 is an end, cross-sectional view of the mattress and bed covering of FIG. 1, taken along line 2—2 in the direction of the arrows.
Figure 3:
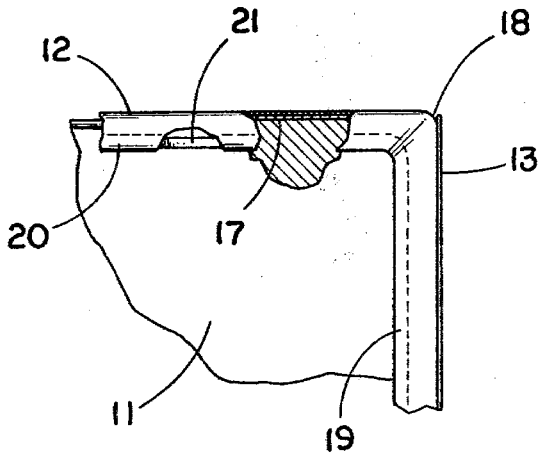
FIG. 3 is a bottom, partially broken view of the mattress and bed covering of FIG. 1, taken along the line 3—3 in the direction of the arrows.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, there is shown a preferred embodiment of the improved bed covering 10 of the present invention installed upon a mattress 11. The improved bed covering comprises a first sheet 12 and a second sheet 13 secured thereto as will be described.

The first sheet 12 defines a pocket, indicated generally at 14, adapted for fitting upon the end of the mattress. This pocket may desirably be formed as a standard pocket of a contour or fitted sheet, and the first sheet preferably includes a second pocket to fit upon the opposite end of the mattress. The first sheet defines the pocket as follows. The first sheet 12 includes a top portion 15 to overlie the mattress and further includes side portions 16 and an end portion 17 depending from corresponding sides and an end of the top portion, respectively. The side portions 16 are attached to the end portion 17 at the corner locations 18 corresponding to the end corners of the mattress. The side and end portions include extensions 19 and 20, respectively, adapted to underlie the mattress. The first sheet 12 thus defines the pocket 14 by the top, side and end portions and the extensions of the side and end portions.

The second sheet 13 is secured to the first sheet 12 adjacent the extension of the end portion of the first sheet. Preferably, the first sheet extends adjacent the end portion 17 of the first sheet 12 and also adjacent the extension 20 of the first sheet and is secured most preferably along the periphery of the extension of the end portion of the first sheet. The second sheet 13 is also secured to the first sheet 12 adjacent the corner locations 18. It is preferred that the second sheet be secured to the first sheet at the seam location and for the equivalent width of the side and end portions of the first sheet, but not along the extensions of the side and end portions. Most suitably the connections of the side and end portions with one another and of the second sheet to the first sheet are accomplished by stitching as is customary in the production of such sheets. The described bed covering may be prepared by the attachment of the standard flat sheet to a standard contour or fitted sheet or may even be formed by the appropriate stitching, typically at the corner locations, of a single, continuous length of sheet material. As is common with contour sheets, the extensions of the side and end portions of the first sheet may include a strip of elastic material 21 to facilitate fitting of the first sheet to the end of the mattress.

In accordance with the bed covering of the present invention, a bed covering is provided which has several advantages over the prior art constructions. Since the typical contour and flat sheets are combined in a fashion by the present invention, the storage and inventorying of sheets is simplified. A single bed covering is required to prepare a bed with both the bottom sheet and the top sheet. The availability of both a bottom sheet and a top sheet for a given bed is assured by this design. Further, the making of a bed is simpler and quicker since the bottom sheet may simply be installed on the bed in the usual fashion for a contour sheet and the top sheet is then drawn up upon the bed. There is no need for separately installing the second sheet, and particularly, there is no need to secure the bottom end of the top sheet under the mattress. Since the top sheet is already secured to the bottom contour sheet, the amount of material required for the top sheet is reduced since it does not have to extend under the mattress to the extent necessary with separate top sheets. The savings in material for a top sheet will typically be a foot or more of material. In addition, the bed covering of the present invention provides a manner for readily making a bed while the finished or made bed is not restricted in availability or access.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. An improved bed covering which comprises:

a first sheet defining a pocket adapted for fitting upon an end of a mattress, said first sheet including a top portion to overlie the mattress, said first sheet further including side portions and an end portion depending from corresponding sides and an end of the top portion, respectively, the side portions being attached to the end portions at corner locations corresponding to the end corners of the mattress, the side and end portions including extensions adapted to underlie the mattress, the pocket being defined by the top, side and end portions and the extensions of the side and end portions; and a second sheet secured to said first sheet adjacent the corner locations, said second sheet being unsecured to said first sheet along the side portions of said first sheet, whereby installing said first sheet to the end of a mattress secures said second sheet to the mattress.

2. The bed covering of claim 1 in which said second sheet is secured to said first sheet by stitching.

3. The bed covering of claim 1 in which the side of said first sheet are secured to the end portion of said first sheet by stitching.

4. The bed covering of claim 1 in which the extensions of the side and end portions of said first sheet include a strip of elastic material to facilitate fitting of said first sheet to the end of a mattress.

5. The bed covering of claim 4 in which the side portions of said first sheet are secured to the end portion of said first sheet by stitching.

6. The bed covering of claim 5 in which said second sheet is secured to said first sheet by stitching.

7. The bed covering of claim 1 in which said first sheet is a fitted contour sheet.

8. The bed covering of claim 7 in which said second sheet is a flat sheet secured to said first sheet by stitching.

9. The bed covering of claim 8 in which the extensions of the side and end portions of said first sheet include a strip of elastic material to facilitate fitting of said first sheet to the end of a mattress.

10. The bed covering of claim 1 in which said first and second sheets comprise a one-piece, continuous length of material secured by stitching to define the side and end portions.

* * * * *